US009558723B2

(12) United States Patent
Young et al.

(10) Patent No.: US 9,558,723 B2
(45) Date of Patent: Jan. 31, 2017

(54) CONTOURED GUITAR TREMOLO ARM

(71) Applicants: David Young, San Diego, CA (US); Robert Scott Fisher, Encinitas, CA (US)

(72) Inventors: David Young, San Diego, CA (US); Robert Scott Fisher, Encinitas, CA (US)

( * ) Notice: Subject to any disclaimer, the term of this patent is extended or adjusted under 35 U.S.C. 154(b) by 207 days.

(21) Appl. No.: 14/326,970

(22) Filed: Jul. 9, 2014

(65) Prior Publication Data

US 2015/0027293 A1 Jan. 29, 2015

Related U.S. Application Data

(63) Continuation-in-part of application No. 14/320,302, filed on Jun. 30, 2014, now Pat. No. 9,286,864.

(60) Provisional application No. 61/857,394, filed on Jul. 23, 2013, provisional application No. 61/899,537, filed on Nov. 4, 2013.

(51) Int. Cl.

| | |
|---|---|
| ***G10D 3/14*** | (2006.01) |
| ***G10D 3/00*** | (2006.01) |
| ***G10D 1/08*** | (2006.01) |

(52) U.S. Cl.

CPC ..... *G10D 3/146* (2013.01); *G10D 1/085* (2013.01); *G10D 3/00* (2013.01); *G10D 3/14* (2013.01); *G10D 3/143* (2013.01)

(58) Field of Classification Search

CPC ..... G10D 3/146; G10D 3/14; G10D 3/00
USPC ..... 84/313
See application file for complete search history.

(56) References Cited

U.S. PATENT DOCUMENTS

| | | | | | |
|---|---|---|---|---|---|
| 3,162,083 | A | * | 12/1964 | Webster | G10D 3/146 84/313 |
| 4,457,201 | A | * | 7/1984 | Storey | G10D 3/146 84/267 |
| 4,563,934 | A | * | 1/1986 | Keizer | G10D 3/146 84/313 |
| 4,632,004 | A | * | 12/1986 | Steinberger | G10D 3/146 84/304 |
| 4,638,711 | A | * | 1/1987 | Stroh | G10D 3/12 84/298 |
| 4,681,011 | A | * | 7/1987 | Hoshino | G10D 3/146 84/267 |
| D356,328 | S | * | 3/1995 | Pozzobon | D17/21 |
| 5,419,227 | A | * | 5/1995 | Lavineway | G10D 3/146 84/313 |
| 5,429,028 | A | * | 7/1995 | Fisher, IV | G10D 3/146 84/313 |
| 5,808,216 | A | * | 9/1998 | Fisher, IV | G10D 3/146 84/313 |

(Continued)

FOREIGN PATENT DOCUMENTS

| | | | | | |
|---|---|---|---|---|---|
| GB | 2472577 | A | * | 2/2011 | G10D 3/18 |

*Primary Examiner* — Elvin G Enad
*Assistant Examiner* — Christina Schreiber
(74) *Attorney, Agent, or Firm* — Donn K. Harms

(57) ABSTRACT

An improved tremolo arm is provided configured for engagement to a pivoting bridge of a stringed instrument such as a guitar. The arm features a facing surface formed in a complimentary fashion to the shape of the palm of a user's hand. The arm is engageable to conventional bridges or may be employed with an arm mount having a centered attachment point to provide an even pivoting of the bridge during use.

6 Claims, 8 Drawing Sheets

(56) References Cited

U.S. PATENT DOCUMENTS 5,864,074 A * 1/1999 Hill ..... G10D 3/146 84/313
5,939,653 A * 8/1999 Chang ..... G10D 1/085 84/298
6,034,311 A * 3/2000 Fisher, IV ..... G10D 3/146 84/307
6,118,057 A * 9/2000 Chang ..... G10D 3/12 84/298
6,137,039 A * 10/2000 Rose ..... G10H 3/18 84/290
7,045,693 B2 * 5/2006 Rose ..... G10D 3/04 84/298
7,189,908 B2 * 3/2007 Lavineway ..... G10D 3/146 84/313
7,247,780 B2 * 7/2007 Sanders ..... G10D 3/146 84/313
7,521,616 B2 * 4/2009 Kahler ..... G10D 3/146 84/313
7,745,709 B2 * 6/2010 Benjamin ..... G10D 3/146 84/313
8,536,430 B2 * 9/2013 McCabe ..... G10D 3/14 84/312 R
8,766,070 B2 * 7/2014 Zumsteg ..... G10D 3/146 84/313
2004/0074373 A1 * 4/2004 Goto ..... C23C 18/36 84/452 R
2006/0219086 A1 * 10/2006 Sanders ..... G10D 3/146 84/455
2010/0101398 A1 * 4/2010 Benjamin ..... G10D 3/146 84/313
2012/0137851 A1 * 6/2012 van Ekstrom ..... G10D 3/146 84/313
2012/0152082 A1 * 6/2012 Parillo ..... G10D 3/146 84/313
2013/0239771 A1 * 9/2013 Kernick ..... G10D 3/146 84/313
2014/0202307 A1 * 7/2014 Rose ..... G10D 3/146 84/313
2014/0202308 A1 * 7/2014 Maslarov ..... G10D 3/146 84/313
2015/0027292 A1 * 1/2015 Young ..... G10D 3/146 84/313
2015/0027293 A1 * 1/2015 Young ..... G10D 1/085 84/313

* cited by examiner

CONTOURED GUITAR TREMOLO ARM

This application claims priority to U.S. Provisional Patent Application Ser. No. 61/857,394 filed on Jul. 23, 2013 U.S. Provisional Patent Application 61/899,537 filed on Nov. 4, 2013, and Non-Provisional patent application Ser. No. 14/320,302 filed Jun. 30, 2014 all of which are incorporated herein in their respective entirety by this reference thereto.

BACKGROUND OF THE INVENTION

1. Field of the Invention

The present device relates to guitars. More particularly it relates to a tremolo arm for use during the playing of guitars which does require the user to grip the arm with their hand during use.

2. Prior Art

In music, a tremolo is a trembling vibrato effect imparted to the played music heard by the listener. When playing a guitar, a tremolo effect is produced by a variation in amplitude of the produced note.

A variety of mechanical tremolo or vibrato systems for guitars have been developed and employed by musicians since the 1930's and are employed to add a vibrato to the sound of the music, by imparting a change to the tension of the strings. Typically the mechanical action to impart this change in tension is communicated to the bridge or tailpiece of an electric guitar. The implement of choice for most guitarists to impart this tensional variation to elicit the vibrato effect to their music, is a controlling lever, often referred to as a whammy bar, a vibrato armor bar, or a tremolo armor bar.

During guitar playing, gripping the lever by the musician and imparting an oscillating motion to the bar, toward and away from the body of the guitar, enables the player to quickly vary the tension and sometimes the length of the strings temporarily. On an electric guitar this imparted movement of the bridge to vary string length and tension, also moves the strings into differing positions within the magnetic field proximate to the electronic string pickups. Both of these temporary and varying physical changes to the strings, cause a change the pitch of the music produced, to create a vibrato, or pitch-bend effect to the sound.

Since the regular appearance of mechanical vibrato systems generally using gripped-arms to change string tension in the 1950's, such devices have been regularly employed by many guitarists. In the 1960's and 1970's, vibrato or tremolo arms connected to the mount for the guitar strings or bridge, were widely used for significantly more dramatic effects by rock and roll guitarists. Since then the pitch-bending effects produced by movement of the tremolo arm, whether subtle inflections or exaggerated effects, have become an important part of many styles of electric guitar, and a welcome addition to virtually every electric guitar.

Typical prior art is taught in U.S. Pat. No. 2,741,146 by Fender, an example thereof shown in the drawings as prior art, teaches a tremolo device for stringed instruments and which is included in this disclosure as part hereof. Fender teaches a stout handle which is pivotally engaged to a base and which may be rotated out of the way when not in use.

In use in conventional devices like that of Fender, the bar is rotated to a comfortable position for gripping in the hand of the user. Once gripped, the user oscillates movement of the bar by pushing it toward the guitar body, and immediately pulling it back again. This movement produces a tremolo effect in the music through the communicated force in the arm, moving the bridge which affects string length and position over the electronic pickups.

However, systems typical of that taught in Fender have significant shortcomings. First, such long pivoting arms, when pivoted upward toward the strings for use, such conventional tremolo bars are configured for operation using the guitarist's fingers to grip there-around and activate the vibrato action. This concurrently eliminates the employment of the same fingers to continue to pluck or strum the strings of the guitar while using the bar.

Further, conventional tremolo bar systems do not allow the user to keep the tremolo bar in use at all times since it is adapted to fall below the strings when not in use, and out of reach while using the guitar pick or fingers to play. Additionally, because when out of use, they are generally pivoted toward the bottom of the guitar, the conventional elongated tremolo bar must found again by the user's hand, without missing a note while plucking on the guitar in the process.

Still further, as noted, such elongated members are configured to be gripped in the hand between closed fingers for use, and consequently are configured elongated and narrow in width to facilitate such a gripped-use. However this narrow elongated configuration also precludes the musician from attempting to use the member as a hand support during playing since it offers little contact support area and being pivotally engaged it tends to easily rotate in such a hand and lever contact when it is not gripped by the fingers. Finally, many arms such as the Bigsby arms, have a stop built in which prevents the arm from rotating to a position elevated over the strings.

As such, there exists an unmet need for an improved tremolo bar device that allows employment for use with the palm or another surface of the hand which contacts a large planar contact surface, or may be employed by a gripping of the user's fingers along an edge to thereby allow a user to implement the tremolo effect with a surface of their hand while concurrently playing the strings. Additionally such a tremolo device should be configured to be positioned over the strings or adjacent thereto during use or non use, and thereby eliminate the need to search for the tremolo bar as in prior art, when rotated out of use. Still further, such a device should have a contact surface which is contoured in a shape which is complimentary to the curved surface of the hand of a user to achieve a comfortable and secure engagement during use. Finally, such a device should be easily engageable to a wide variety of bridge engagement with stringed instruments as a replacement.

The forgoing examples of related art and limitations related therewith are intended to be illustrative and not exclusive, and they do not imply any limitations on the tremolo device and method described and claimed herein. Various additional limitations of the related art will become apparent to those skilled in the art upon a reading and understanding of the specification below and the accompanying drawings.

OBJECTS OF THE INVENTION

It is an object of the invention to provide a significantly improved tremolo effect imparting device and method for stringed instruments.

It is an additional object of the invention to provide such a tremolo device which is easily adapted for operative engagement with the bridge of a wide variety of stringed instruments such as guitars.

It is a further object of this invention to provide such a device and method which is configured for use while the user concurrently strums the strings of the instrument.

It is yet another object of this invention to provide a tremolo device which is configured on its surface in a fashion that compliments the shape of the surface of a user's hand or forearm for a more secure and comfortable engagement during use, or while supporting the strumming hand.

These and other objects, features, and advantages of the present musical invention, as well as the advantages thereof over existing prior art, which will become apparent from the description to follow, are accomplished by the novel improvements described in this specification and hereinafter of this guitar tremolo arm as described in the following detailed description which fully discloses the invention, which however in no manner should be considered as placing any limitations thereon.

SUMMARY OF THE INVENTION

In accordance with the purposes of the present invention, as embodied and broadly described herein, the present invention provides a device adapted for operative engagement in fixed communication with a pivoting bridge which is operatively engaged with the strings of a guitar or other stringed instrument, which provides a significant improvement in the utility of a stringed instrument tremolo such as, for example, with a guitar.

In all modes, the device has a proximal end adapted for engagement with the string mount of a stringed instrument such as a guitar. Such a mount can be direct using a conventional threaded engagement with the mount, or may employ an interface or adapter between the device and the string mount.

The proximal end of the device includes a passage which is sized for a rotational engagement on a mount which engages with the string mount or an interface component. Particularly preferred in all modes of the device is a shaped front facing surface when the device is in an as-used engagement to the string mount. This shaped surface depends into the facing surface of the device when positioned in an as-used position, providing a contour to the surface which is complimentary to the curved shape of the user's palm or forearm.

This comfortable complimentary engagement allows the device to support the hand or forearm of the user during strumming. A curved edge is easily engaged with the fingers to grip the device to allow the user to move it toward and away from the string instrument body for a tremolo effect.

The device is preferably rotatably engaged to the adapter or a mounting point on the string support or bridge to allow for positioning adjacently, and over the strings, during use. This rotation allows the user to position the device for forearm or palm support during strumming and the curved edge is always available for a gripping by the hand.

In all modes of the device whether engaged to an interface which is engaged to the string mount or bride, or directly to the bridge, the rotational engagement is preferably frictionally enhanced through the provision of means for imparting a biasing force to the device such that a slight force from the user's hand or arm is required to initiate any rotation.

With respect to the above description, before explaining at least one preferred embodiment of the herein disclosed tremolo arm system in detail, it is to be understood that the invention is not limited in its application to the details of construction and to the arrangement of the components in the following description or illustrated in the drawings. The device herein described and disclosed in the various modes and combinations is also capable of other embodiments and of being practiced and carried out in various ways which will be obvious to those skilled in the art. Any such alternative configuration as would occur to those skilled in the art is considered within the scope of this patent. Also, it is to be understood that the phraseology and terminology employed herein are for the purpose of description and should not be regarded as limiting.

As such, those skilled in the art will appreciate that the conception upon which this disclosure is based may readily be utilized as a basis for designing of other palm engageable tremolo activation components for stringed instruments such as guitars, and for carrying out the several purposes of the present disclosed device. It is important, therefore, that the claims be regarded as including such equivalent construction and methodology insofar as they do not depart from the spirit and scope of the present invention.

BRIEF DESCRIPTION OF DRAWING FIGURES

The accompanying drawings, which are incorporated herein and form a part of the specification, illustrate some, but not the only nor exclusive examples of embodiments and/or components of the disclosed device. It is intended that the embodiments and figures disclosed herein are to be considered illustrative of the invention herein, rather than limiting in any fashion. In the drawings.

Figure 1:
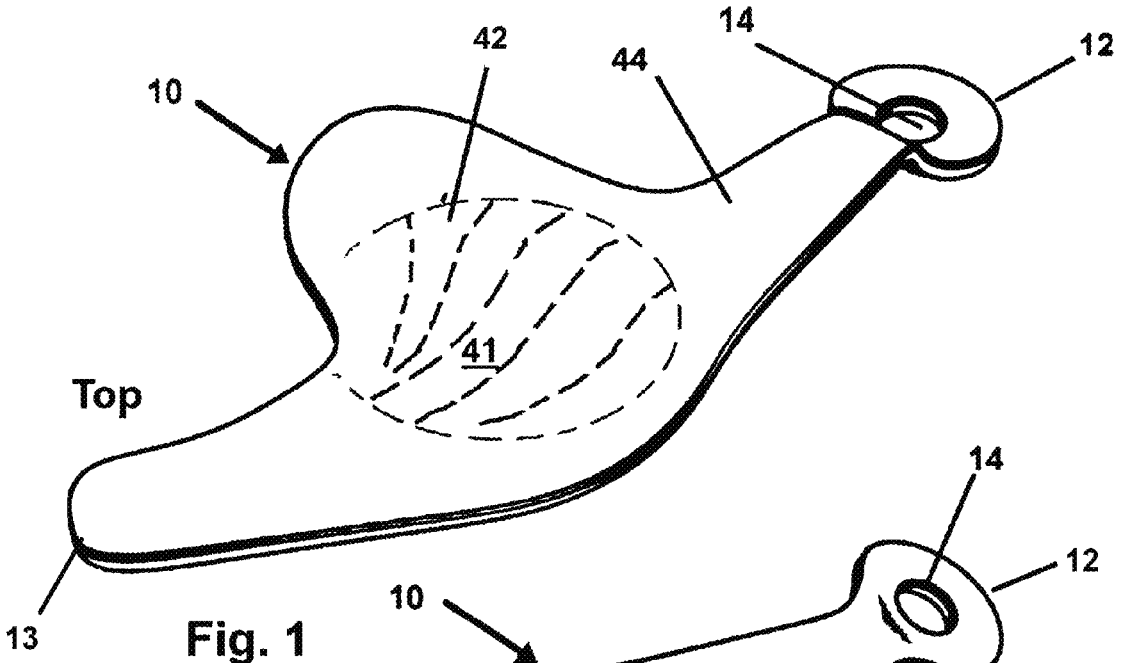
FIG. 1 depicts the disclosed device showing a recessed area providing a contoured shape which is complimentary to the shape for the palm or hand of a user providing a comfortable engagement therein.
Figure 2:
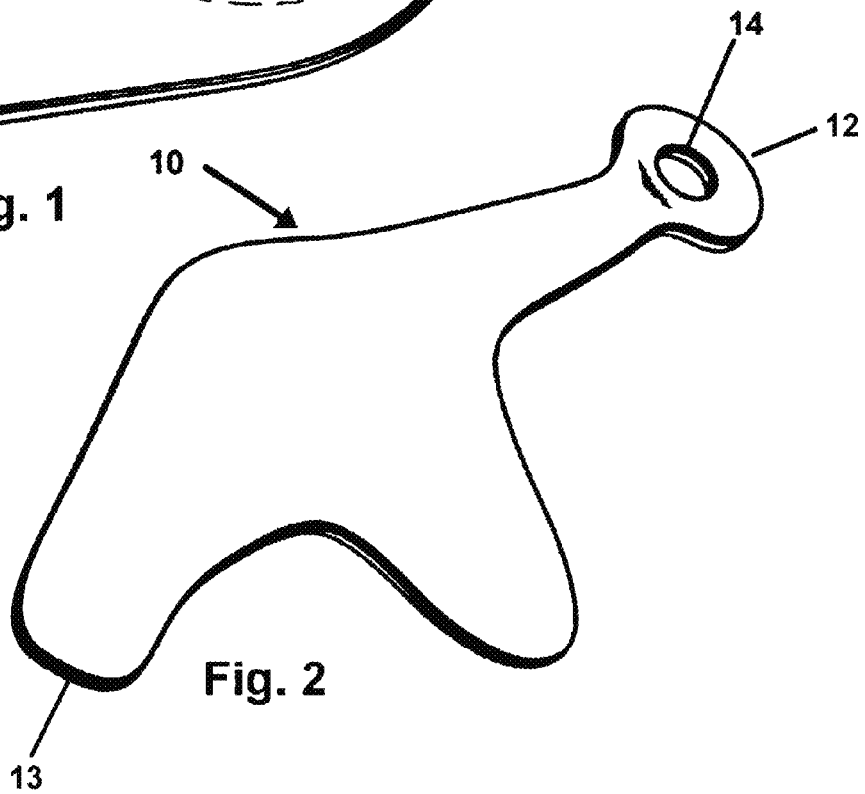
FIG. 2 is a bottom view of the device of FIG. 1.
Figure 1A:
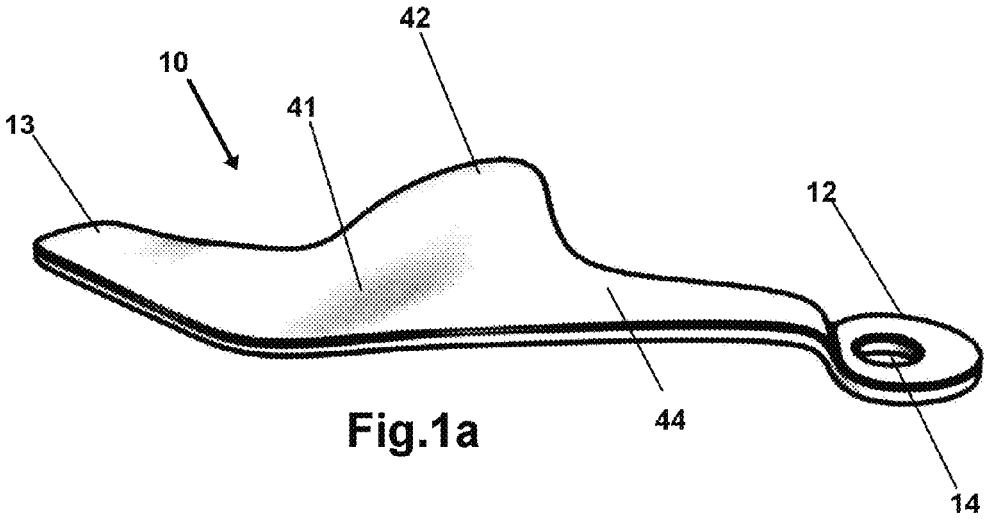

FIG. 1*a* is a perspective view of another mode of the device of FIG. 1 having the Contoured surface.

Figure 2A:
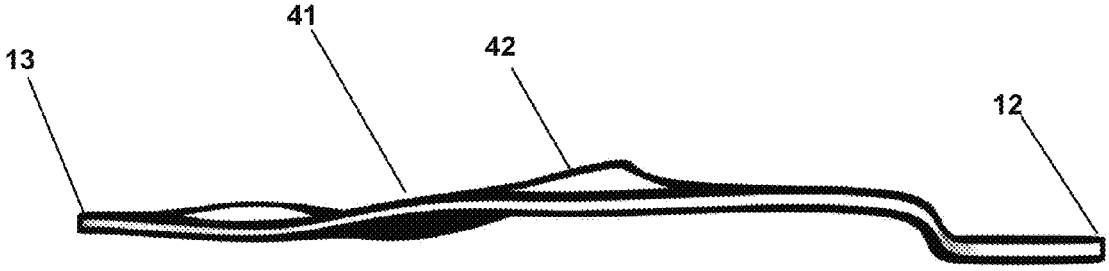

FIG. 2*a* is a side view of FIG. 1*a*.

Figure 3:
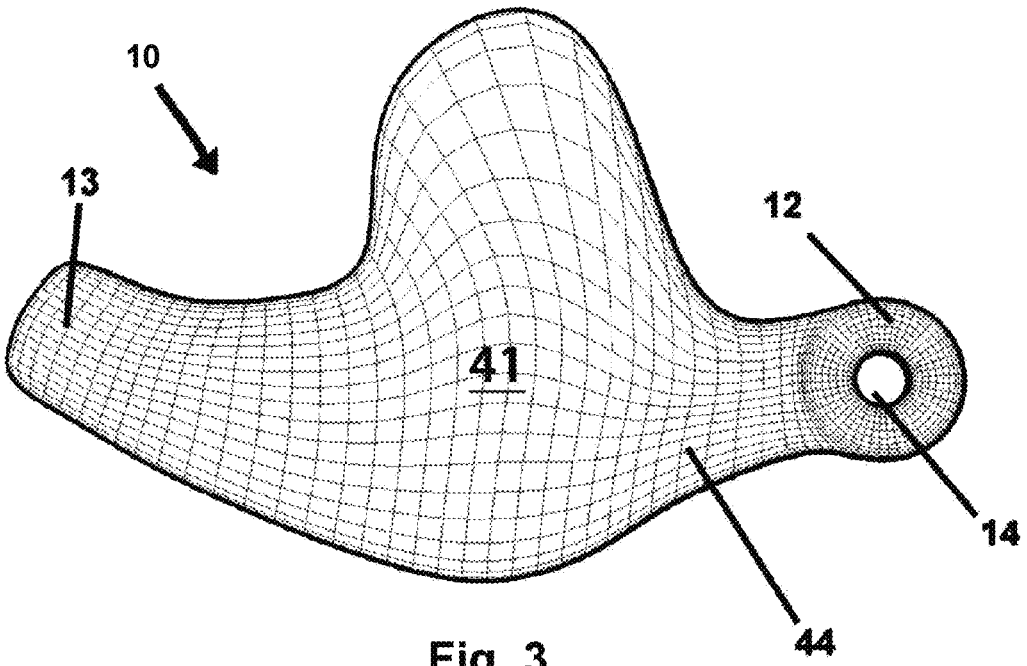

FIG. 3 depicts an overhead plan view of the device of FIG. 2*a* showing the contoured contact surface for complimentary engagement with the hand of a user.

Figure 4:
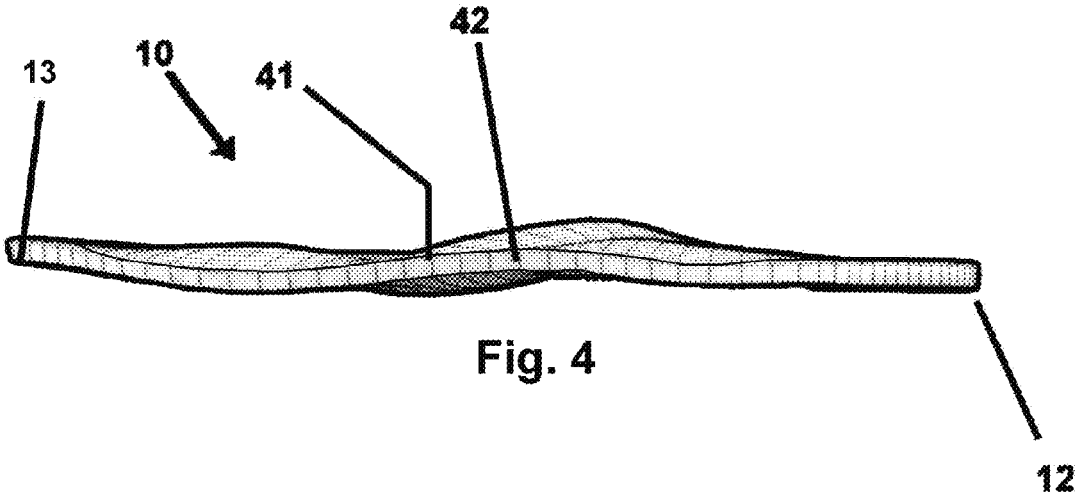

FIG. 4 shows a side view of the device as in FIG. 1*a*.

Figure 5:
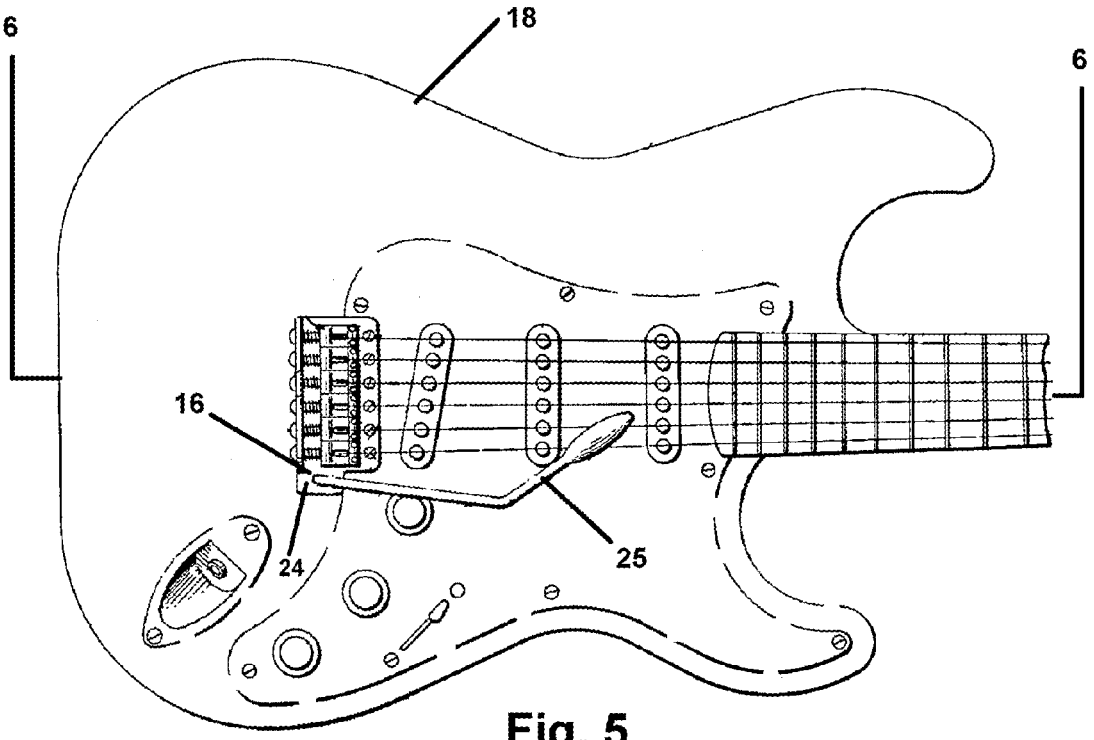
Fig. 5 (Prior Art)

FIG. 5 depicts a typical prior art bar-style tremolo engaged in a threaded rotational mount on one end of a rocking bridge.

Figure 6:
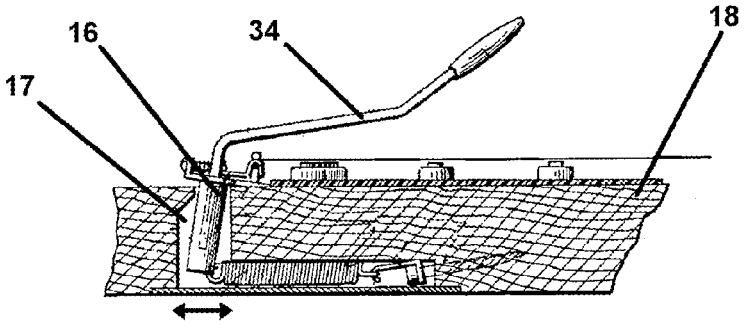
Fig. 6 (Prior Art)

FIG. 6 shows a segment view through guitar body of FIG. 5 showing a cavity occupied by a tail section of the bridge which allows the bridge to rock therein through pressure on an engaged tremolo bar.

Figure 7:
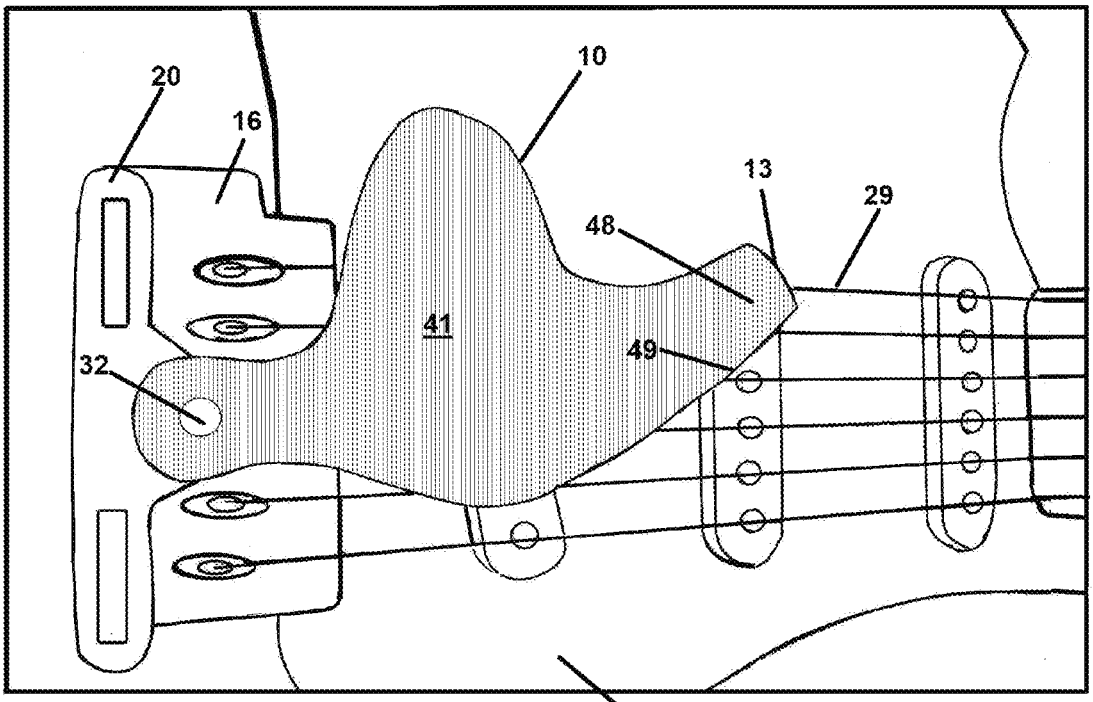

FIG. 7 depicts the device herein in a rotatable engagement at a center area of an interface component with a conventional rocking bridge such as in FIG. 6.

Figure 8:
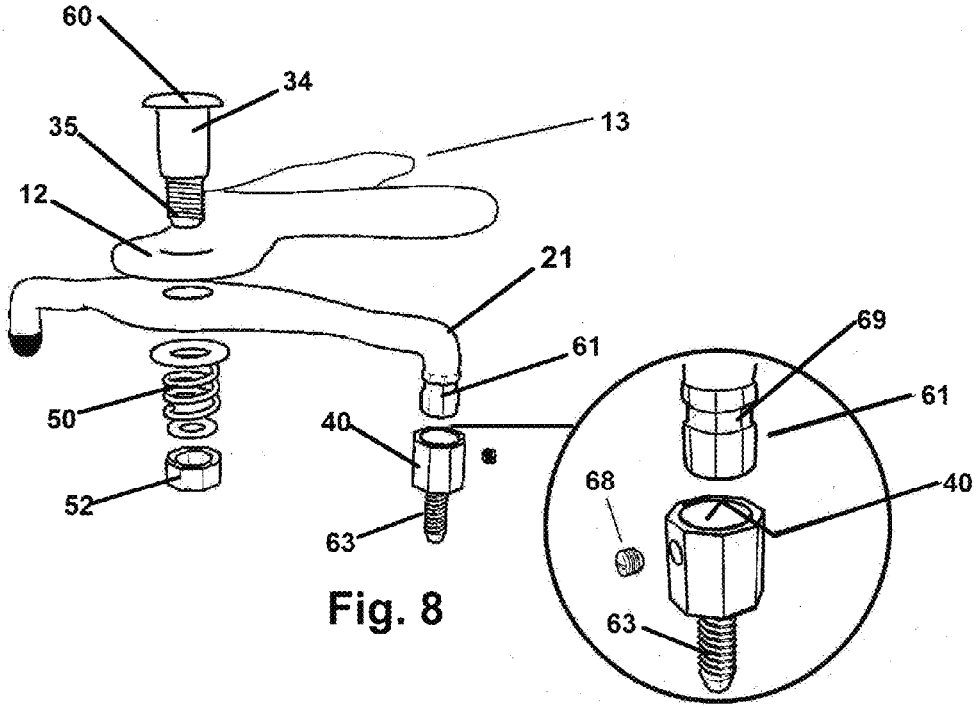

FIG. 8 shows an interface component for the device providing means for engagement to one side of a bridge as in FIG. 5, in a retrofit thereto.

Figure 9:
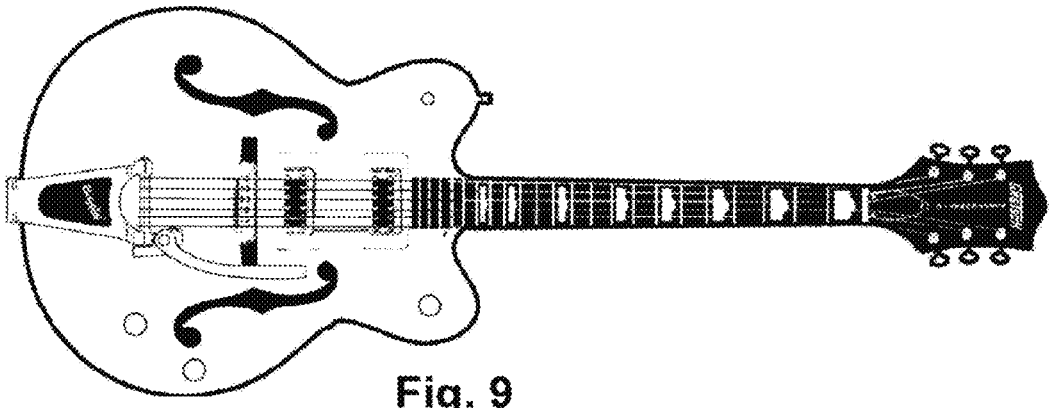
Fig. 9 Prior Art

FIG. 9 is an overhead view of a prior art elongated tremolo arm engaged with conventional Bigsby type string mount.

Figure 10:
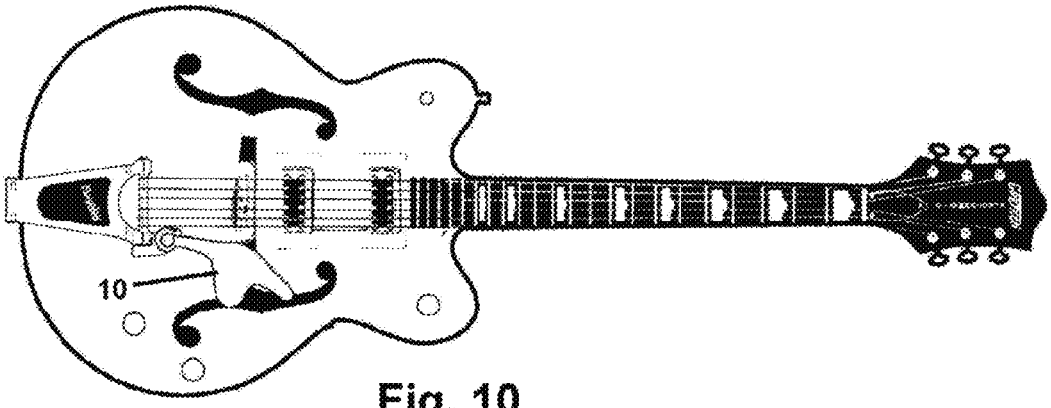

FIG. 10 depicts the device herein engaged with the string mount of FIG. 9 in a rotational engagement.

Figure 11:
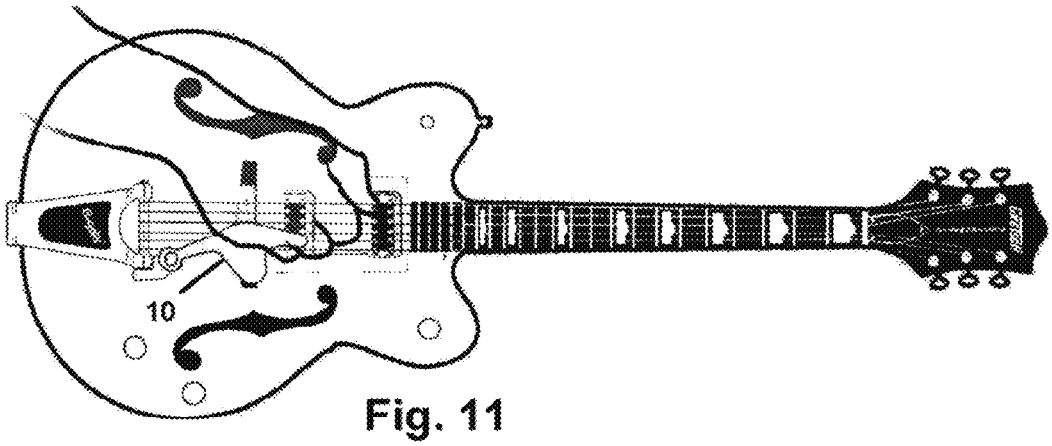

FIG. 11 depicts the device being employed for a tremolo effect by the user gripping on an inward curved edge with their fingers while a curved portion of the palm is in complimentary engagement with a recess formed in a first side surface of the tremolo bar which is in operative engagement to an as-used position with a bridge.

Figure 12:
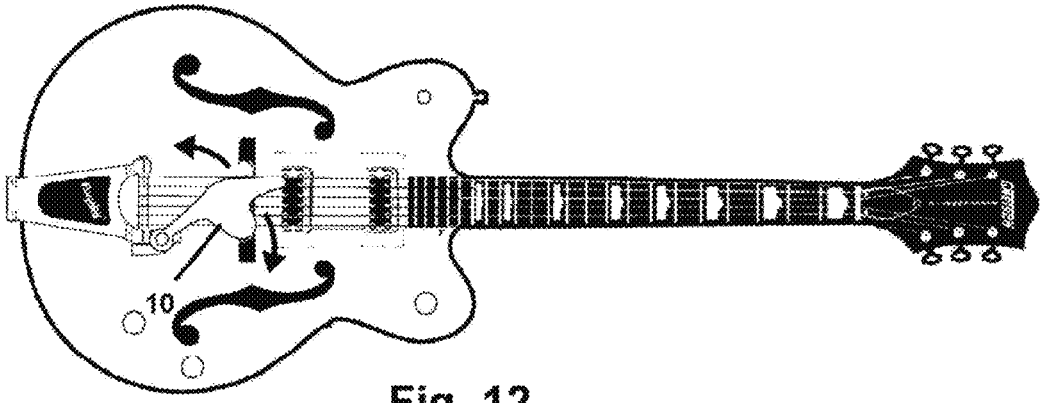
Figure 16:
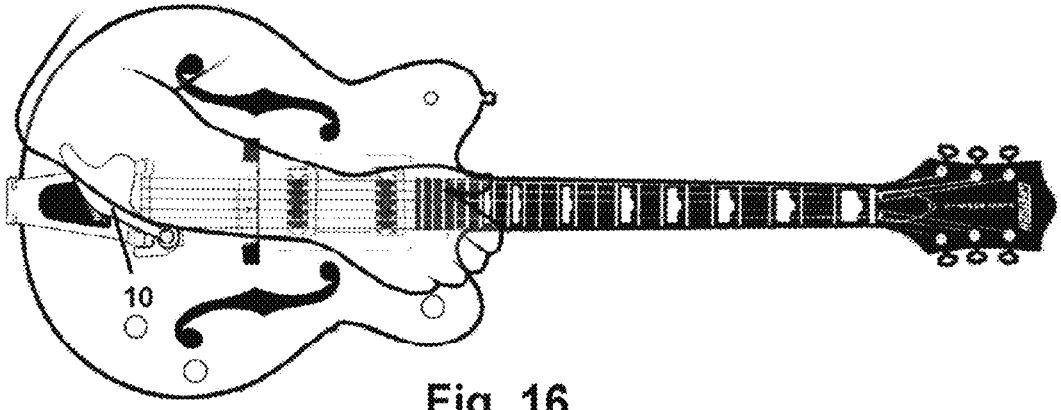

FIG. 12 shows the device rotated to a second position above the strings of a guitar wherein it will support the forearm of the user as in FIG. 16.

Figure 13:
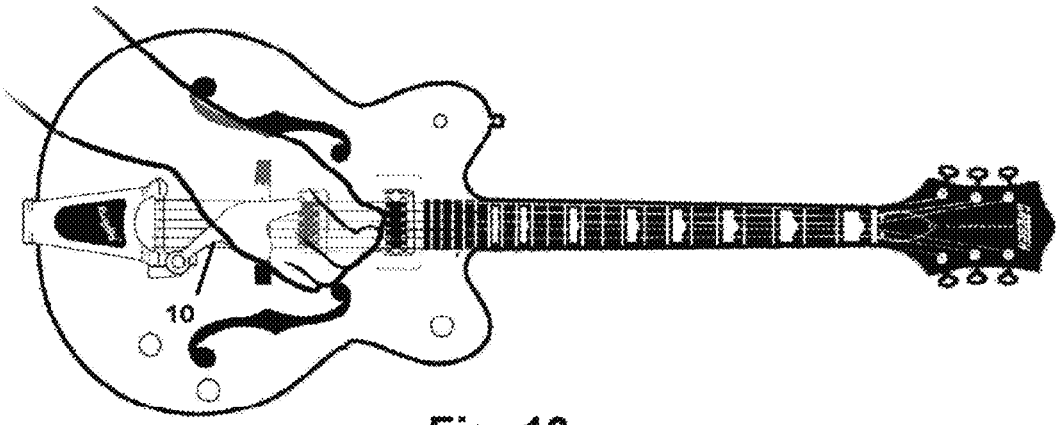

FIG. 13 depicts the device with the Contoured surface in a comfortable complimentary engagement with the palm wherein the device supports the strumming hand during use.

Figure 14:
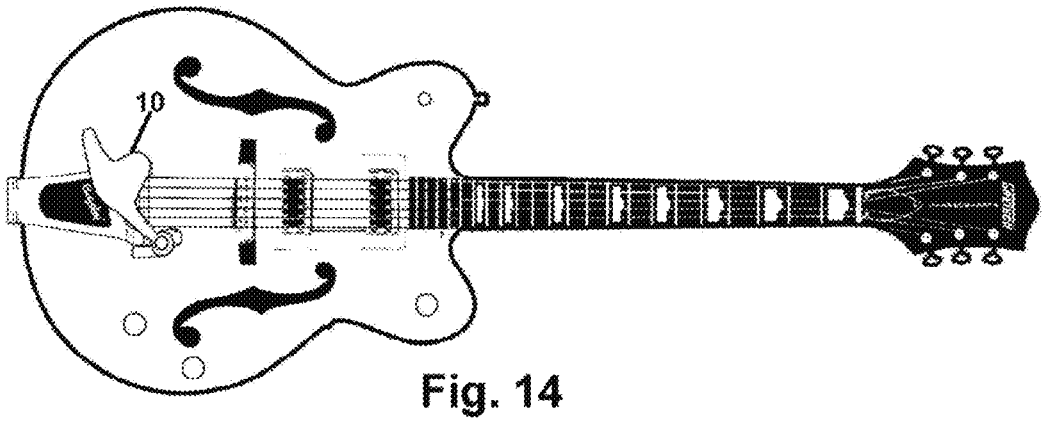

FIG. 14 depicts the device rotated to a position wherein the contoured surface is complimentary to the curved forearm surface and employable for support thereof as in FIG. 16.

Figure 15:
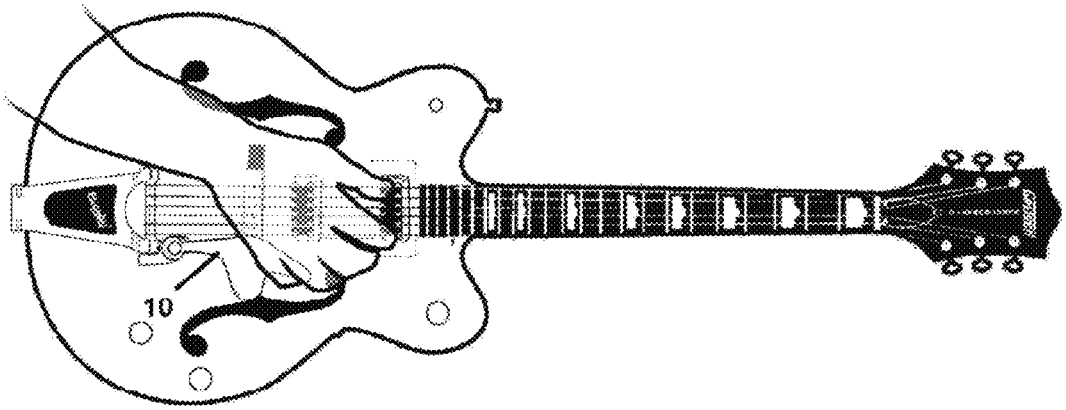

FIG. 15 shows the device employed for support of the strumming hand of the user and the provision of easy transition to and from the tremolo engagement of FIG. 11.

FIG. 16 depicts the device in the position of FIG. 14 with the Contoured surface providing a means for complimentary engagement with the curved forearm surface.

DETAILED DESCRIPTION OF THE INVENTION

Now referring to drawings in FIGS. 1-16, wherein similar components of the device 10 and method herein, are identified by like reference numerals, there is seen in FIG. 1 a favored mode of the disclosed device 10 herein. As depicted, the device has a proximal end 12 having a passage 14 therethrough which adapted for an engagement to the bridge 16 (FIGS. 5 and 7) of a stringed instrument such as a guitar 18 (FIGS. 5 and 7).

This engagement may be enabled using an adapter 20 such as in FIG. 7 which engages with the bridge 16 and provides a centered mount thereover, or using an adapter 21 configured to engage with the proximal end 12 of the device 10 and to engage with the mount 24 positioned on one end of the bridge 16 as in FIG. 5 which is a common engagement for the bar-style tremolo shown in FIG. 5. This mount 24 is conventionally a threaded aperture which cooperatively engages with threads on the elongated bar 25 or and interface therewith.

A centered engagement such as in FIG. 7 is achievable with a bridge bracket or mount 24 and is preferable in that centering the proximal end 12 of the device 10 in an engagement in the central area of the bridge 16 will tend to cause a rotation of the bridge 16 within the cavity 17 of a conventional guitar 18, evenly and aligned with the axis of the cavity 17. Engagement with the mount 24 on one end of the bridge 16 as in FIG. 5, while a significant enhancement over the bar 25, can tend to rock the axis of the bridge 16 out of alignment with the axis of the cavity 17. This causes an unequal change in string 29 length during a tremolo effect, and can make some strings seem out of tune. A rocking or pivoting of the bridge 16, keeping its axis aligned with the resting axis within the cavity 17 however, will tend to change the string 29 length equally and give a much better sound.

Such a centered mount as in FIG. 7, will either require an adapter 20 to engage the bridge 16 and provide a mounting point 32 for the device 10, or, a bridge 16, configured with a substantially centered or centrally located mount 24 for the device 10.

The proximal end 12 of the device 10 is shown with the passage 14 which is sized for a rotational means for engagement on a mount 34 which is shown best in FIG. 8 as a shoulder bolt wherein threads 35 are configured complimentary to the threaded mount 14 on one end or a central area of the bridge 16. Alternatively, if an adapter 20 or 21 for instance is employed, the complimentary threaded mount 34 would be configured to threadably engage with, or through the adapter 20 or 21.

Particularly preferred in the device 10 as shown in FIG. 1, is a shaped surface 41 in a central area 42 positioned between the proximal end 12 and distal end 13. This shaped surface 41 depends into the facing surface 44 of the device 10 when positioned in an as-used position, such as in FIG. 7, poised for the user to employ and engaged to the guitar 18.

Preferably the shaped surface 41 depends into the facing surface 44 in the central area 42, in a manner to form a recess or recesses which are complimentary to the shape of the human palm, such that the palm of the user will fit securely and comfortably into the shaped surface 41. This allows the user to support their hand over the strings 29 during use comfortably engaged with the shaped surface 41.

Between the central area 42 and the distal end 13 is positioned a distal extension 48 terminating at an edge at the distal end 13. A gripping edge 49 is positioned so it may be engaged by a wrap-around of the fingers of the user who has his hand or palm concurrently engaged in the complimentary shaped contoured surface 41. With the user's palm comfortably engaged with the complimentary shaped contoured shaped surface 41 they may comfortably grip the edge 49 to push and pull the device 10 and cause a rocking of the bridge 16 within the cavity 17.

The device 10 is preferably rotatably engaged to the adapter or a mounting point 24 on the middle or end of a bridge 16 directly. This rotational engagement of the proximal end 42 allows the device 10 to be rotated from over the strings 29 as in FIG. 7, to a position where the extension 48 extends at an angle traverse to the strings 29 and below them, and allowing the user hand support against the device 10 while strumming or plucking the strings 29 during use. This gives the user a fixed and solid stand to rest their palm or a hand surface upon for steadiness while playing the strings 29.

Another favored dimension shown in FIG. 3, for a width of the central area 42 between the proximal end 12 and distal end 13 is between 50 to 70 mm with 65 mm having been found to be a size which will accommodate the size of a majority of guitar player's hands comfortable. The side view of FIG. 4 shows the central area 42 and the shaped surface 41 depending into the central area 42 as a means for cooperative engagement with the Contoured surface which is formed complimentary to the shape of the palm of the user's hand during use.

As depicted in FIGS. 5 and 6, there is shown a typical prior art bar-style, tremolo bar which will rotate in a threaded or other engagement with the mounting point 24 on a bridge 16 and may be employed to rock the bridge 16 within a cavity 17 of the guitar 18 body while engaged to one end of a moveable bridge. As noted, the device 10 herein can be adapted to make the same engagement in a retrofit, either using a threaded mount 34 though the passage 14 and into the mount 24, or by using the interface adapter of FIG. 8. The device 10 adapted to engage the mount 24 either with a retrofit, or directly, provides a significant enhancement with its contoured surface dimensioned to provide a complimentary engagement with the curved palm of the user and may be positioned in numerous positions adjacent and above the strings where prior art tremolo arms are not positionable in a manner where they are useable.

In all modes of the device 10 wherever engaged, it is preferred that the rotational engagement is frictionally enhanced through the provision of a biasing force which thereafter requires a slight user force to initiate any rotation. One means for biasing and thereby providing a frictional enhancement that may be overcome by user force, is shown in FIG. 8. As disclosed as in FIG. 7, a spring 50 may be compressed by a nut 52 which engages the threads 35 of the threaded mount 34 and thereby cause a sandwiched biasing of the proximal end 12 of the device, between a shoulder 60 of the threaded mount 34 and a surface of the adapter 21. The amount of the spring induced bias can be adjusted higher by tightening the nut 52 to compress the spring 50 or loosening the nut 52 to expand the spring 50 and lower the frictional force preventing a free rotation of the device 10 at the proximal end 12 engagement.

Also depicted in FIG. 7, is a mode of rotational engagement of an end 61 of a mount 21, with a cavity 17 having a screw member 63 for engagement with a mount 24 such as a conventional mount 24 on a bridge 16 as in FIGS. 6-7. The end 61 is sized to rotate within the cavity 17 and is maintained there by a set screw 68 which operatively engages within a recess 69 to hold the end 61 in the rotational engagement in the cavity 17.

It should be noted, any of the different configurations and components for operative engagement of the device 10 to the mount 24 for the strings of a stringed instrument such as a guitar can be employed, with any other configuration or component shown and described herein, to configure the device 10 for the operative engagement to a stringed instrument or employ the method herein. In all modes of such engagement, the contoured surface providing a complimentary engagement with the curved palm of the user's hand.

Additionally, while the present invention has been described herein with reference to particular embodiments thereof a latitude of modifications, various changes and substitutions are intended in the foregoing disclosures, it will be appreciated that in some instance some components, or configurations, or steps in formation and/or use of the invention could be employed without a corresponding use of other components without departing from the scope of the invention as set forth in the following claims. All such changes, alternations and modifications as would occur to those skilled in the art are considered to be within the scope of this invention as broadly defined in the appended claims.

Further, the purpose of any abstract of this specification is to enable the U.S. Patent and Trademark Office, the public generally, and especially the scientists, engineers, and practitioners in the art who are not familiar with patent or legal terms or phraseology, to determine quickly from a cursory inspection the nature and essence of the technical disclosure of the application. Any such abstract is neither intended to define the invention of the application, which is measured by the claims, nor is it intended to be limiting, as to the scope of the invention in any way.

What is claimed is:

1. A tremolo arm, comprising:

a planar member having a proximal end opposite a distal end;

said proximal end configured to operatively engage with a guitar bridge to an as-used engagement, said planar member having a first side edge extending between said proximal end and said distal end;

said planar member having a second side edge extending between said proximal end and said distal end, said second side edge being opposite said first side edge;

said first side edge extending in an arched curve between said proximal end and said distal end;

said second side edge having a projecting edge portion proximal to said proximal end, said projecting edge portion defining a projection extending in a direction away from said first side edge and in between said proximal end and said distal end;

said second side edge having a curved section extending from said distal end to an intersection with said projecting edge;

said curved section defining a grip for fingers of a user to engage during a translation of said tremolo arm toward and away from an underlying guitar body; and a first side surface of said planar member having a contour positioned in a central area between said proximal end, said distal end, and said first side edge and said second side edge, wherein said contour provides a complimentary engagement with an exterior of a palm of said user of said guitar with said planar member in said as-used engagement.

2. The tremolo arm of claim 1 additionally comprising:

said contour having a recess formed into said first side surface, said recess having a curve configured to accommodate the curve of a human hand on a side of the palm, opposite the thumb of said hand.

3. The tremolo arm of claim 2 additionally comprising:

said proximal end configured to said operatively engage with a guitar bridge with an aperture located adjacent said proximal end communicating thorough said planar member; and said aperture sized for rotational engagement with a mount component communicating therethrough.

4. The tremolo arm of claim 3 additionally comprising:

a mount, said mount having a body having a first side configured for attachment to said bridge; and a mount aperture positioned on said mount, said mount aperture configured for cooperative engagement with one end of said mount component extending from a communication through said aperture.

5. The tremolo arm of claim 1 additionally comprising:

said proximal end configured to said operatively engage with a guitar bridge with an aperture located adjacent said proximal end communicating thorough said planar member; and said aperture sized for rotational engagement with a mount component communicating therethrough.

6. The tremolo arm of claim 5 additionally comprising:

a mount, said mount having a body having a first side configured for attachment to said bridge; and a mount aperture positioned on said mount, said mount aperture configured for cooperative engagement with one end of said mount component extending from a communication through said aperture.

* * * * *